United States Patent [19]

Thieme

[11] Patent Number: 5,014,614

[45] Date of Patent: May 14, 1991

[54] CAP PRINTING DEVICE AND METHOD

[76] Inventor: Gaylord G. Thieme, 298 Wellsian Way, Richland, Wash. 99352

[21] Appl. No.: 374,355

[22] Filed: Jun. 30, 1989

[51] Int. Cl.[5] ..... B41F 15/18; B41F 17/00

[52] U.S. Cl. ..... 101/35; 101/126; 101/128.1; 101/474; 101/485

[58] Field of Search ..... 101/35, 126, 474, 127.1, 101/128.1, 129, 485

[56] References Cited

U.S. PATENT DOCUMENTS

| | | | |
|---|---|---|---|
| Re. 32,731 | 8/1988 | Jennings | 101/35 |
| 1,128,225 | 2/1915 | Choate | 400/128 X |
| 1,252,043 | 1/1918 | Shourt | 101/40.1 |
| 1,477,282 | 12/1923 | Reynolds | 101/41 |
| 1,537,191 | 5/1925 | Reynolds | 101/41 |
| 1,600,077 | 9/1926 | Swanzey | 101/38.1 X |
| 1,727,416 | 9/1929 | Smith | 400/128 X |
| 1,856,921 | 5/1932 | Lowenthal | 223/24 |
| 2,340,979 | 2/1944 | Ostolaza | 101/38.1 X |
| 2,900,751 | 8/1959 | Mintz | 101/27 |
| 2,963,964 | 12/1960 | Klump | 101/123 |
| 3,036,698 | 5/1962 | Gronmeyer | 223/24 |
| 3,244,093 | 4/1966 | Vasilantone | 101/126 |
| 4,266,476 | 5/1981 | Maloof | 101/35 |
| 4,381,706 | 5/1983 | Harpold | 101/127.1 |
| 4,438,693 | 3/1984 | Serrianne | 101/129 |
| 4,590,854 | 5/1986 | Anderson | 101/35 |
| 4,753,161 | 6/1988 | Kimball | 101/35 |

OTHER PUBLICATIONS

Richardson Industries Advertisement.
Hix Direct Advertisement, p. 5.

*Primary Examiner*—Clifford D. Crowder
*Attorney, Agent, or Firm*—Klarquist, Sparkman, Campbell, Leigh & Whinston

[57] ABSTRACT

A cap printing device for printing various logos on the surface of billed caps comprises a lower support structure, with one end of this structure connected to a flat platen. The platen is connected to a guide mechanism which contains a slot, for mounting the cap bill, and a framing bar, for flattening the front panel of a cap and holding it on the platen. The platen is curved so as to alleviate stresses which arise upon flattening. An upper support arm supports a silk screen carrier with removable silk screen frames. The arm is movably connected at the opposite end of the support structure.

10 Claims, 4 Drawing Sheets

CAP PRINTING DEVICE AND METHOD

BACKGROUND OF THE INVENTION

This invention relates generally to cap printing devices, and more particularly to an improved silk screen cap printing device.

Caps imprinted with logos are common sights in today's world. These logos impart various messages, from those of athletic organizations to advertisements, promotions, political slogans, and the like. The present invention is an improved cap printing device which can imprint the logo on the front panel of a cap in a high quality manner, free of any distortions. These distortions, which give the cap an unaesthetic appearance, are caused by printing the logo on an unevenly stressed surface. Wrinkles and stretches are caused by stresses, formed while attempting to obtain a completely flat printing surface. Distortion is most evident at the corners of the surface, which tend to be arced and out of alignment.

Printing logos onto caps by using silk screens is well known in the art. Typical cap printing devices are disclosed in U.S. Pat. No. 4,266,476 to Maloof, U.S. Pat. No. 4,381,706 to Harpold, and U.S. Pat. No. 4,590,854 to Anderson. These patents disclose curved platens with curved silk screens. There are numerous problems with these curved platens and screens.

Initially, with a curved screen, the artist must be extremely skilled so as to produce a symmetric design, proportional to the curvature of the caps to be printed. But regardless of the artist's skill, the logos may still be out of proportion as the curvature of the cap may be different from that of the screen on which the artist works or the platen on which the cap is held. Additionally, the logo may have smears and bare spots as the operator can not uniformly ink a curved screen as his hand must bend according to the screen's curvature.

Cap printing devices with flat platens are also known in the art. However, these devices fail to totally flatten the front panel of a cap on the platen, leaving an unevenly stressed, wrinkled or stretched printing surface. The resulting logo, when printed on an unevenly stressed surface, is distorted.

U.S. Pat. No. Re. 32,731 to Jennings attempts to solve this problem by providing a flat platen with a unique blocking device. The blocking device holds the cap in place and attempts to flatten the front panel of the cap on the platen during printing. While this device has yielded better results, the printed logos are still distorted since the front panel of the cap is still not held completely flat on the straight edged platen. Rather, only those surfaces of the cap front panel in contact with the platen edges are flat. Additionally, since the bill rests against a registration plate perpendicular to the platen, additional stresses at the point where the bill meets the front panel may give rise to wrinkles. Some of this additional stress is relieved as part of the sweatband is held between the platen and the plate. However, this sweatband holding mechanism may not relieve all of the stresses on the front panel of the cap because operating the mechanism depends on the operator's judgment. In one instance, the sweatband may not be pulled down enough, causing the front panel near the bill to rise off the platen surface. The logo printed would be distorted or the sweatband may be pulled down too much, causing the fabric to stretch off the platen. The logo printed would again be distorted.

Another problem with the prior art devices is cap alignment on the platen, so as to centrally print the logo on the cap. This alignment is commonly known as registration. Conventional registration is illustrated in U.S. Pat. No. 4,590,580 issued to Anderson, where the cap is manually centered by the machine operator. Blocking as a means of registration is proposed by Maloof, Harpold and Jennings. But the possibilities for an off-center logo due to cap slippage or poor operator placement remain. These problems are even more common when the caps are mass produced quickly.

Still another problem with the prior art devices is that the silk screens are not interchangeable. In these devices an entire frame containing the silk screen has to be removed from the device each time the printing is changed. These frames are rather large and hence cumbersome to manipulate and inconvenient to store.

SUMMARY OF THE INVENTION

An object of the invention, therefore, is to provide an improved cap printing device for printing a flat design on a flat front panel of a cap resting on a flat platen.

Another object of the invention to economically mass produce caps with high quality logo prints where the logo will be uniformly positioned and undistorted.

Still another object of the invention is to provide a guide mechanism which centrally aligns the cap with high reliability and is not dependent on the operator's skill.

Still another object of the invention is to provide such a guide mechanism, that is movable between a cap loading position and a printing position.

Yet another object of the invention is to provide a substantially flat platen with curved edges for minimizing stress in the front panel of the cap.

Still another object of the invention is to place the front panel of the cap on the platen and flatly retain it stress-free thereon, absent any wrinkles or stretches, whereby the logo may be transferred to the front panel undistorted.

Still another object of the invention is to provide a flat platen, with curved edges for alleviating additional stresses, allowing a larger platen surface for printing.

Still another object of the invention is to provide a cap printing device with a flat silk screen, whereby the logo transferred will be free of smears or bare spots as the flat screen can be uniformly inked by the operator in a single motion.

Still a further object of the invention is to provide a cap printing device with interchangeable silk screens, whereby only the screen need be removed from the device.

In accordance with the invention, the cap printing device includes a substantially flat platen. A cap guide mechanism operably attached to the platen and engages both sides of the cap bill for holding the bill in registered relation to the platen. A clamping means such as a framing bar is operatively attached to the guide mechanism for clamping the front panel of the cap to the platen surface. An upper arm of the cap printing device supports a silk screen carrier which carries a removable frame that holds a silk screen. Once inked, the screens are placed in contact with the front panel of the cap, which is clamped to the platen, and the logo is printed in a conventional manner.

Other objects and advantages of the present invention will be apparent from the following detailed description of several preferred embodiments thereof.

DETAILED DESCRIPTION

Figure 1:
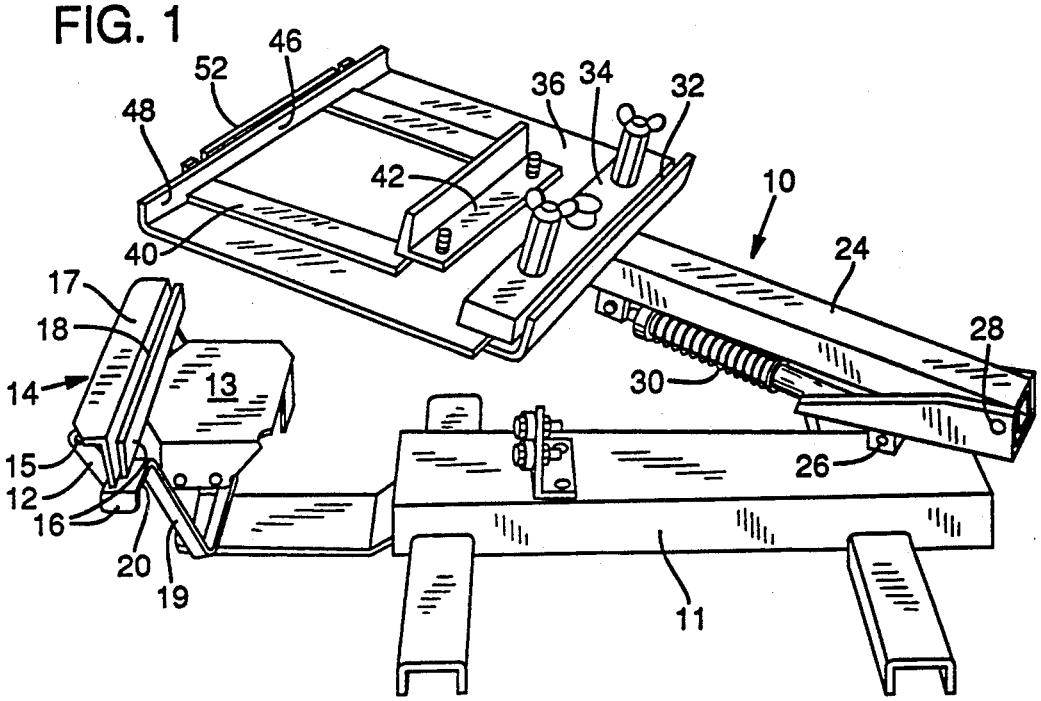
FIG. 1 is a perspective view of a cap printing device according to the invention, including the first embodiment of a clamp for clamping the front panel of a cap to a platen.
Figure 2:
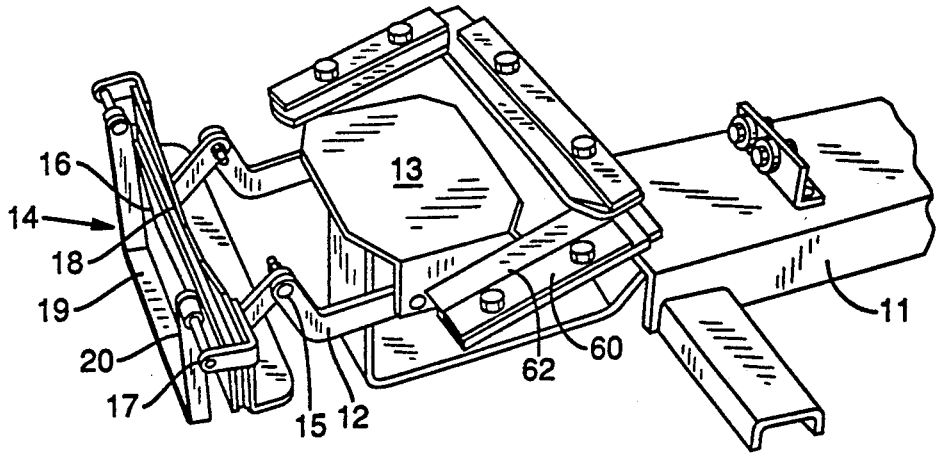
FIG. 2 is a partial view of the device illustrating a platen and a second embodiment of the clamp.
Figure 8:
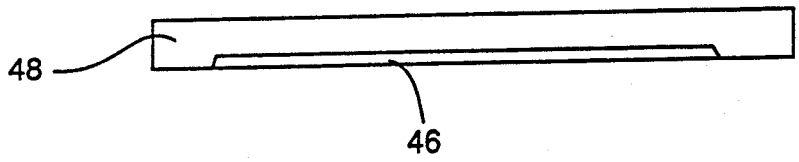
FIG. 8 is a top view of the silk screen carrier of FIG. 6 showing a slot for accepting a silk screen frame.
Figure 3:
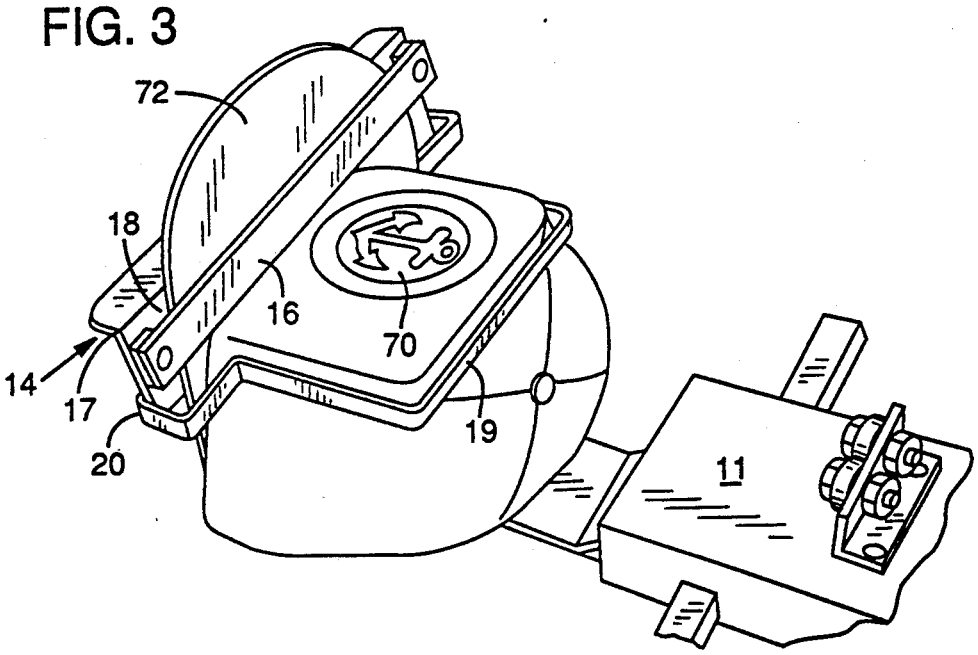
FIG. 3 is a partial view of the device illustrating a guide mechanism and clamp for registering the cap on the platen and holding it thereon.

Turning now to the drawings, wherein like components are designated by like reference numerals throughout the various figures, attention is first directed to FIGS. 1 and 2. The cap printing device 10 comprises a lower support structure 11, that supports a substantially flat platen 13 at the support's front end. Attached to the platen 13 is a guide mechanism 14. The guide mechanism 14 is operatively attached to the platen 13 by a pair of hinges 15 and bars 12. The hinges 15 allow the guide mechanism 14 to move between a cap mounting position (FIG. 2) and a printing position (FIGS. 1 and 3). While a hinge is the preferred connection, other equivalent connections which allow movement of the mechanism may also be used.

The guide mechanism 14 comprises a pair of spaced-apart members: a top piece 16 and a platform 17. Connecting the platform 17 to the platen 13 by way of bars 12 are the hinges 15. The preferred platform is "L" shaped, however flat shapes and other suitable shapes may also be used. The top piece 16 and platform 17 are designed to engage both sides of the bill of a cap by forming a slot 18 for holding the bill in predetermined relation to the platen 13. The top piece 16 is spaced apart from platform 17 a distance slightly greater than the height of the cap bill. This distance is chosen so as to allow the bill to easily enter the slot 18, while allowing little if any bill movement once in place. This tight fit enables the cap to be centrally aligned or "registered" on the platen 13, eliminating the need for the machine operator's sight judgement. The slot 18 may also be open ended, such as may be formed by a clip or other means equivalent to the illustrated guide mechanism.

Means such as a framing bar 19 are provided for clamping the front panel of a cap to the platen 13. The bar 19 is attached to the platform 17 by a pair of hinges 20. In the cap mounting position, shown in FIG. 2, the bar 19 moves freely. With the cap front panel resting on the platen, the guide mechanism 14 is moved to its printing position and the bar 19 clamps the front panel of the cap to the platen. This action holds the panel flat on the platen, under tension, and substantially free of undesired stresses (FIG. 3). These undesired stresses otherwise cause wrinkling and stretching of the front panel and produce a distorted design upon printing. The preferred framing bar 19 is sized to surround a portion of the cap-supporting surface of the platen 13. As will be explained, this enables bar 19 to clamp the front panel to the platen side skirts.

Referring again to FIG. 1, a bracket 22 which supports an upper arm 24 is attached to the rear end of the lower support structure 11 by a joint 26. This joint 26 allows the upper arm 24, resting in the bracket 22, to laterally rotate. The upper arm 24 may move up and down as it is connected to the bracket 22 by a hinge 28 and a support spring 30. This upper arm 24 terminates in an "L" shaped end plate 32, which supports a clamp 34. A removable silk screen carrier 36 with a rectangular opening (shown in FIG. 6) is clamped between the lower end of the "L" shaped end plate 32 and the clamp 34. While the disclosed clamping arrangement is preferred, other suitable attachment means such as a clip may be used to attach the carrier 36 to the upper arm 24.

A silk screen is mounted within a frame 40, which is removably secured to the silk screen carrier 36. The silk screen frame 40 is aligned over an opening in the silk screen carrier 36 to allow the logo or other image on the screen to be transferred to the cap. Since the silk screen is flat, it can be inked in a uniform motion, lessening the chance of producing a logo with ink smears or bare spots. The frame 40 is removably secured to the silk screen carrier 36 at one end by a clamp 42, located near the flat end of the silk screen carrier 36. At its other end, the frame 40 includes a lip 52, bent at approximately 90 degrees. The lip 52 engages a similar lip 48 of the carrier 36 when the frame 40 is inserted through an adjacent slot 46 in the remote end of the carrier.

While this silk screen carrier-frame mounting arrangement is preferred, other suitable mounting means, such as screws, clips or both may be used. Additionally, the silk screen carrier 36 and the frame 40 could both be flat, provided the mounting means chosen were suitable to retain the silk screen during printing. Please refer to the description of FIG. 6 below for an additional discussion of the silk screen carrier and the framed silk screen frame.

Referring again to FIG. 2, a second embodiment of the clamping means is also illustrated. In this embodiment, such means comprise a bent framing bar 60 that holds the front panel of a cap to the platen. The bar 60 surrounds the cap on its three sides that do not attach to the cap bill. This bent bar 60 is physically separated from the rest of the cap printing device 10, and cooperates with the platen 13 when a cap rests on it. While three bars configured in a "U" shape and extending slightly greater than the corresponding length and width of the platen 4 are preferred for the bar 60, the number and lengths of the bars may be altered if desired.

FIG. 3 shows the cap retained in the printing position immediately after printing. In this position, the bar 19 frictionally engages the front panel 70 of the cap, providing a flat, evenly tensed surface for printing. Additional stresses at the point where the cap bill 72 connects to the front panel 70 are alleviated by the curvature of the front edge 80 of the platen (shown in FIG. 5), which presses against the cap at this connection.

Figure 4:
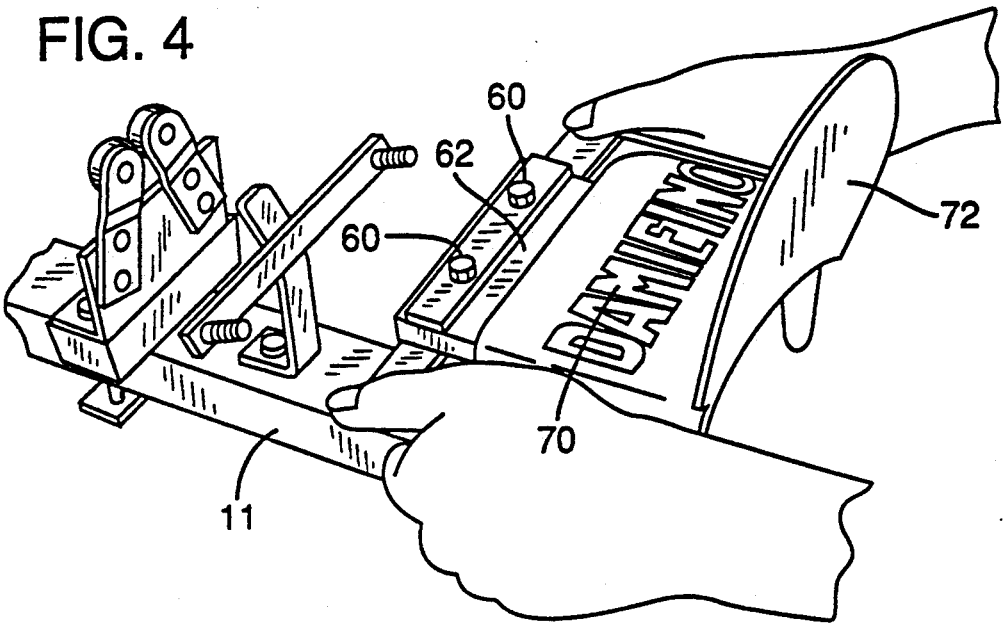
FIG. 4 is another view of the second embodiment of the clamp of FIG. 2.

FIG. 4 shows a cap retained by the bent bar 60 in the cap printing position immediately after printing. Pads 62 attached to each bar segment frictionally engage the front panel 70 of the cap, providing a flat surface with the tension evenly distributed. Additional stresses are eliminated by the curvature of the platen edge 80 (shown in FIG. 5). While pads 62 of a resilient material are employed as friction enhancing spacers, the invention will fully operate with other suitable spacers or completely without the pads 62.

Figure 5:
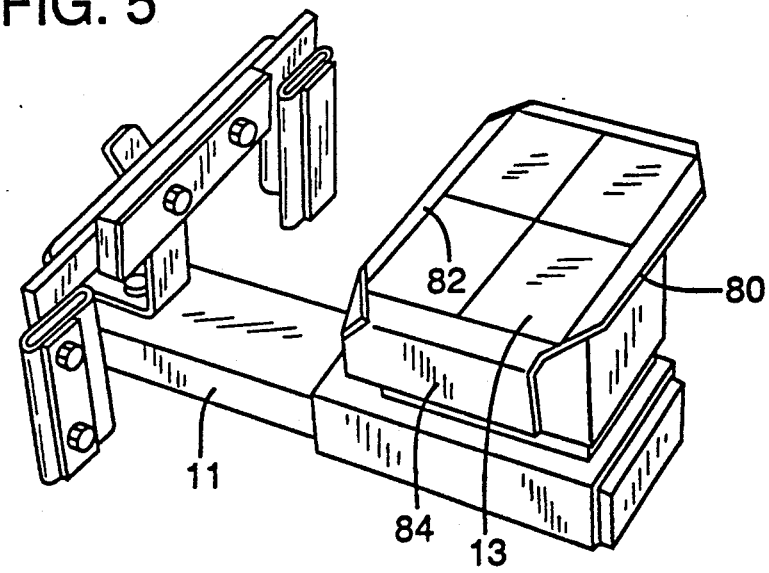
FIG. 5 is a partial view of the device illustrating a platen according to the invention.

FIG. 5 is a top view of a platen 13 according to the invention. The platen 13 has the curved front edge 80 that contacts the cap at a point where the front panel of the cap meets the cap bill (FIGS. 3 and 4). While a second order curve is preferred, third, forth and other higher order curves may be used depending on the stresses caused by the particular curvature of each specific cap. This curved front edge 80 aids in providing an evenly tensed, flat surface for printing by alleviating stresses created at the connection of the cap front panel and bill when the front panel of the cap is clamped to the platen 13.

The rear platen edge 82 opposite the curved edge 80 is curved to conform to the shape of the cap when clamped to the cap-supporting surface of the platen 13. This edge 82 alleviates additional stresses. Stress relief is also provided by side skirts 84, attached to opposing linear edges of the platen 13. The curved edges 80 and 82 alleviate a significant amount of stress and keep the cap panel flat, free of wrinkles or stretches. Most of the platen surface area is thus usable for printing.

Figure 6:
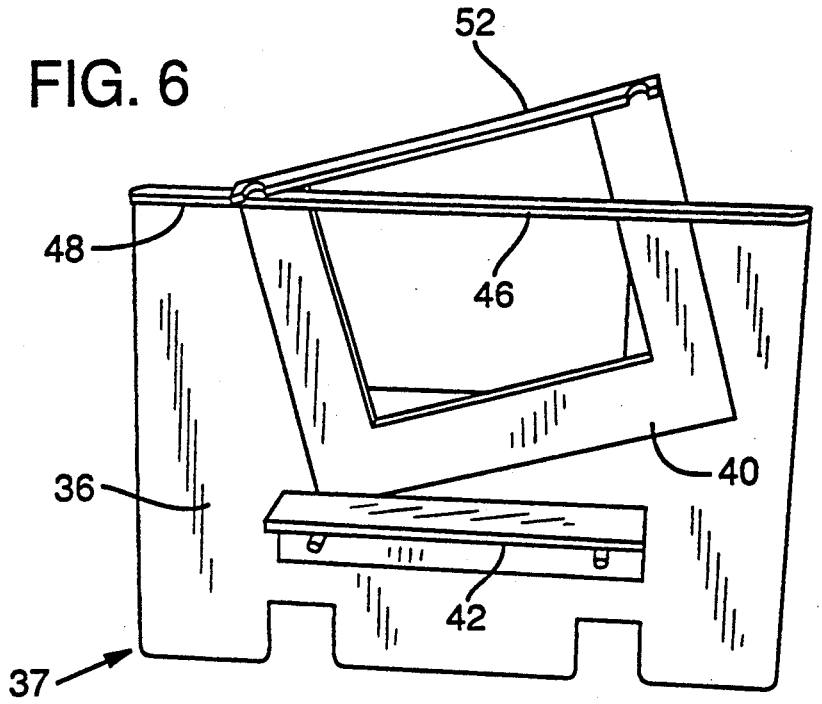
FIG. 6 is a view of a silk screen carrier and silk screen frame according to the invention, and illustrated apart from the cap printing device.

FIG. 6 is a view of the silk screen carrier 36 and silk screen frame 40 apart from the printing device 10, having been removed from the upper arm 24 (shown in FIG. 1). From this view, the removability of the silk screen frame 40 is better illustrated. Since these silk screen frames are compact and easily removable, they can be stored in a stacking type arrangement and new frames with different silk screens may be quickly interchanged on the silk screen carrier 36. The coincidental relationship between the silk screen within the frame 40 and the rectangular opening in silk screen carrier 36 is seen.

Figure 7:
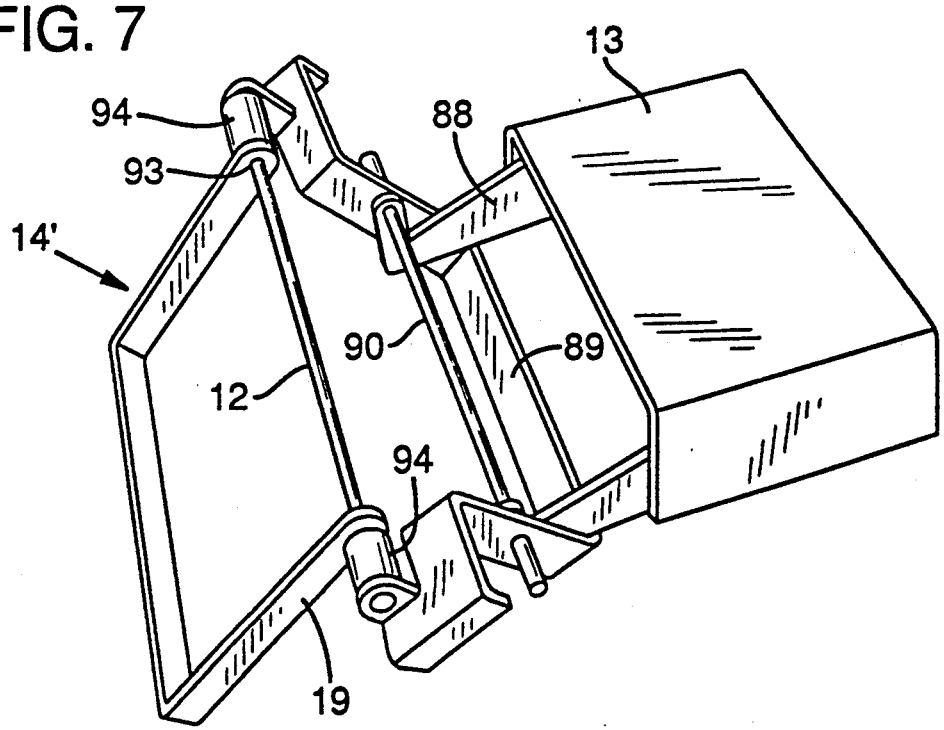
FIG. 7 is a view of the platen and a second embodiment of the guide mechanism.

FIG. 7 shows a second embodiment of the guide mechanism 14'. The guide mechanism 14' is connected to the platen 13 by arms 88 which are fixed to the platen 13. The guide mechanism 14' comprises a "U" shaped support bar 89 which rotates about an axle 90 that attaches the support bar 89 to the platen arm 88. A rod 92 is attached to the upper end of bar 89 to form bill holding slots 93 with "L" shaped portions 94 of the bar 89. The rod 92 is positioned at a height, slightly greater than that of the cap bill, allowing minimum movement of the bill once mounted. By minimizing bill movement, the cap does not slip when moved from the mounting position to the printing position. The cap is centrally registered for printing, minimizing the need for an operator's sight judgment. The framing bar 19 may be attached to the bar 89.

In describing the operation of the two disclosed embodiments, reference is made to all drawing figures. The first embodiment operates as the bill of a cap is placed on the platform 17 of the guide mechanism 14 and is inserted into the bill holding slot 18. The guide mechanism 14 is initially in the cap mounting position (FIG. 2).

Once the cap is mounted, the guide mechanism 14 is moved to the printing position (FIGS. 1 and 3). At this time, the front panel 70 of the cap rests centrally on the cap supporting surface of platen 13. The movable bar 19, hinged to the platform 17, is placed over the front of the cap 70, clamping the panel against the platen side skirts 84. Due to the platen's curved edges 80 and 82, stresses on the front panel are substantially alleviated despite the clamping engagement (FIG. 3).

Once the front panel 70 of the cap is flattened on the platen 13, a silk screen within the frame 40 is oriented over the opening in the silk screen carrier 36 and the frame is clamped to the carrier. The framed silk screen is inked and the upper arm 24 is rotated to position the silk screen directly over the flattened front panel 70. The upper arm 24 is then lowered until the inked silk screen contacts the front panel 70. The screen is then squeegeed to transfer the logo to the cap's front panel without distortion.

The upper arm 24 is now raised so that the framed silk screen may be inked again or replaced with another framed silk screen. If replaced, the silk screen frame 40 may be stored in a stacked arrangement.

Once the logo is printed on the front panel of the cap, the movable framing bar 19 is rotated free of the platen 13 and the guide mechanism 14 is rotated to the cap mounting position (FIG. 2). The cap can then be removed from the slot 18.

In the second embodiment (FIG. 4), the guide mechanism 14 and attached bar 19 may be replaced with the framing bar 60 as a means for clamping the front panel 70 to the platen 13. The bar 60 with pads 62 is placed over the front panel 70, frictionally engaging this front panel and holding and flattening it on the platen 13. Due to the platen's curved edges 80 and 82, the stresses on the panel 70 are substantially alleviated upon this frictional engagement.

As in the first embodiment, once the front panel of the cap 70 is flattened on the platen 13, a silk screen within frame 40 is oriented over the rectangular opening in silk screen carrier 36 and the frame is clamped to the carrier. The silk screen is then inked and the upper arm 24 is rotated to position the silk screen directly over the flattened front panel of the cap 70. The upper arm 24 is then lowered until the inked silk screen contacts the flattened front panel of the cap 70. The screen is then squeegeed to transfer the logo without distortion.

Having described herein various embodiments of the present invention, it is not intended that the invention be limited to the specific forms described above. For example, the size of the screens, platens, guide mechanisms, and other parameters may be varied within the scope of the present invention. Thus, the present invention shall not be limited or restricted to specific details set forth herein, and the invention shall be considered as falling within the scope of the following claims.

I claim:

1. Cap mounting apparatus for a cap printing device, the device including a platen for supporting a cap of the type having a front panel and a bill, the apparatus comprising;

a guide mechanism operatively attached to the platen for registering a cap on the platen, the guide mechanism including a pair of spaced-apart members defining a slot through which the cap bill is inserted to engage both sides of the cap bill for holding the bill in relation to the platen, one member of the pair operable to press against the front panel of the cap to clamp a first portion of the panel to the platen; and a clamp operatively attached to one of the guide mechanism and platen and operable for clamping a second portion of the front panel of the cap to the platen.

2. The apparatus of claim 1 wherein the platen includes a cap supporting surface and side skirts and the clamp comprises a frame sized to surround a portion of the platen surface for clamping the second portion of the front panel of the cap to the platen side skirts.

3. The device of claim 1 wherein one edge of the platen is curved.

4. The device of claim 1 wherein the edge of the platen opposite the curved edge is shaped to conform to the shape of the cap when clamped to the platen.

5. Cap mounting apparatus for a cap printing device, the device including a platen for supporting a cap of the type having a front panel and a bill, the apparatus comprising, a guide mechanism pivotally attached to the platen for registering a cap on the platen, the guide mechanism operable to engage both sides of the cap bill for holding the bill in relation to the platen; and a frame pivotally attached to one of the guide mechanism and platen and operable to surround a portion of the platen for clamping the front panel of the cap to the platen.

6. The apparatus of claim 5 wherein the guide mechanism comprises a pair of spaced-apart members defining slot through which the cap bill is inserted for engaging the bill of the cap, one of the members operable to press against a front panel edge to clamp the edge to the platen.

7. A cap printing device for silk screen printing on caps of a type having a front panel and a bill, comprising:

a platen having a flat surface for supporting the front panel of the cap;

a guide mechanism pivotally attached to the platen for registering a cap on the platen, the guide mechanism defining a slot through which the cap bill is inserted to engage both sides of the cap bill;

a frame pivotally attached to one of the guide mechanism and platen and operable to surround a portion of the platen for clamping the front panel of the cap to the platen.

an arm for positioning the silk screen over the front panel of the cap when supported on the platen;

a silk screen carrier defining an opening for the silk screen attached to the arm; and a flat silk screen frame for holding the silk screen flat against the clamped front panel of the cap, the frame removably attached to the screen carrier, wherein one silk screen frame may be interchanged with another without removing the silk screen carrier from the cap printing device or unclamping the front panel of the cap from the platen.

8. The device of claim 7 wherein the silk screen carrier includes a clamp for clamping the silk screen frame to the carrier and a slot for receiving the silk screen frame and positioning it on the carrier for clamping in a predetermined relation to the platen.

9. The device of claim 8 wherein the silk screen carrier includes a lip and the silk screen fame includes a lip, the frame lip engaging the lip of the silk screen carrier as the frame is inserted fully through the slot.

10. A method of silk screen printing onto the front panel of a cap of the type having a bill comprising the following steps taken in order:

providing a platen having side skirts;

engaging both sides of the bill of the cap to register the cap in relation to the platen;

positioning the front panel of the registered cap on the platen; and clamping the front panel to the platen by pressing the front panel against side skirts of the platen.

* * * * *